US005681211A

United States Patent [19]

Wiand

[11] Patent Number: 5,681,211

[45] Date of Patent: Oct. 28, 1997

[54] DROP-ON GRINDING BIT FOR A GRINDING APPARATUS

[75] Inventor: Richard K. Wiand, Birmingham, Mich.

[73] Assignee: Inland Craft Products Co., Madison Heights, Mich.

[21] Appl. No.: 602,948

[22] Filed: Feb. 16, 1996

Related U.S. Application Data

[63] Continuation-in-part of Ser. No. 353,086, Dec. 9, 1994, Pat. No. 5,586,928, which is a continuation-in-part of Ser. No. 271,135, Jul. 6, 1994, Pat. No. 5,549,509.

[51] Int. Cl.[6] ..... B24B 7/07

[52] U.S. Cl. ..... 451/177; 451/178; 451/342; 451/496

[58] Field of Search ..... 451/177, 360, 451/912, 477, 478, 178, 496, 502, 342, 155

[56] References Cited

U.S. PATENT DOCUMENTS

| | | | |
|---|---|---|---|
| 1,984,453 | 12/1934 | Bates et al. . | |
| 2,543,193 | 2/1951 | Palotsee . | |
| 2,700,851 | 2/1955 | Fuglie . | |
| 2,749,680 | 6/1956 | Palley | 451/496 |
| 3,902,279 | 9/1975 | Lookadoo . | |
| 3,968,728 | 7/1976 | Goldfarb . | |
| 4,423,568 | 1/1984 | Gould . | |
| 4,516,357 | 5/1985 | Gach . | |
| 4,551,948 | 11/1985 | Kindig . | |
| 4,555,199 | 11/1985 | Maier et al. | 451/342 |
| 5,345,726 | 9/1994 | Gach . | |

*Primary Examiner*—Robert A. Rose
*Assistant Examiner*—George Nguyen
*Attorney, Agent, or Firm*—Harness, Dickey & Pierce, P.L.C.

[57] ABSTRACT

A grinding wheel assembly to be mounted on a vertical drive shaft extending from an electric motor through a horizontal table of a grinding apparatus. The grinding wheel assembly includes a core element that is rigidly secured to the drive shaft. A drop-on cylindrical grinding bit of the grinding bit assembly is slidably engaged onto a cylindrical portion of the core element. A slot is formed in the cylindrical portion of the core element and a ridge is formed on the internal bore of the grinding bit so that when the grinding bit is placed on the core element, the grinding bit will rotate upon rotation of the drive shaft.

7 Claims, 7 Drawing Sheets

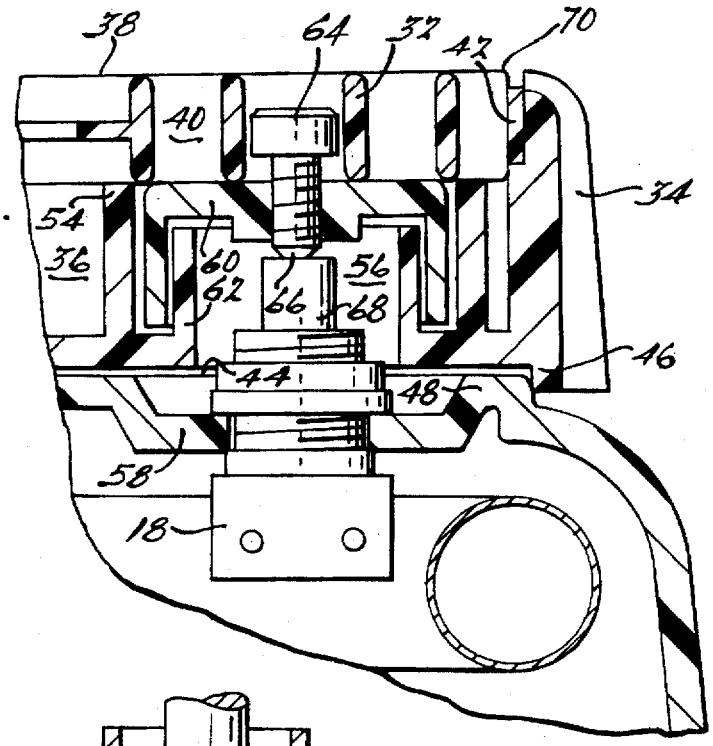
FIG. 4.
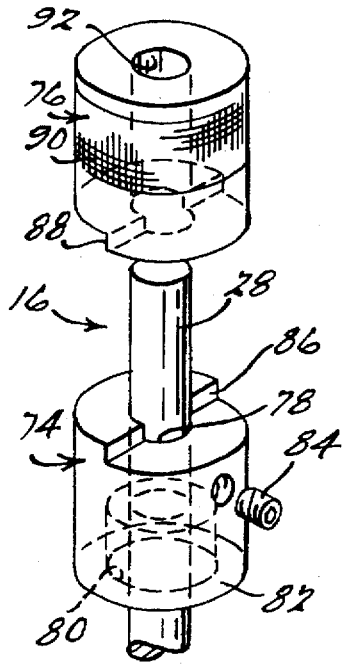
FIG. 5.
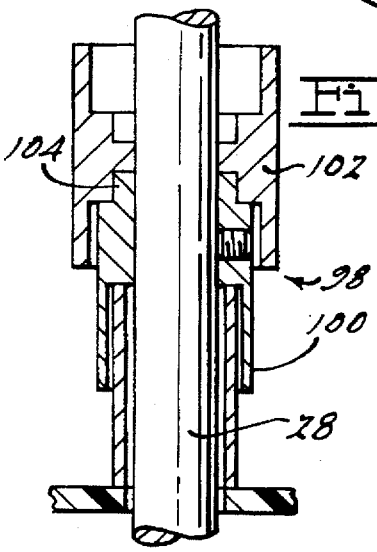
FIG. 6.
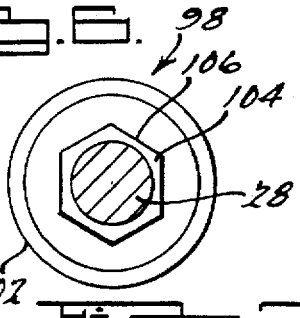
FIG. 7.
FIG. 8.
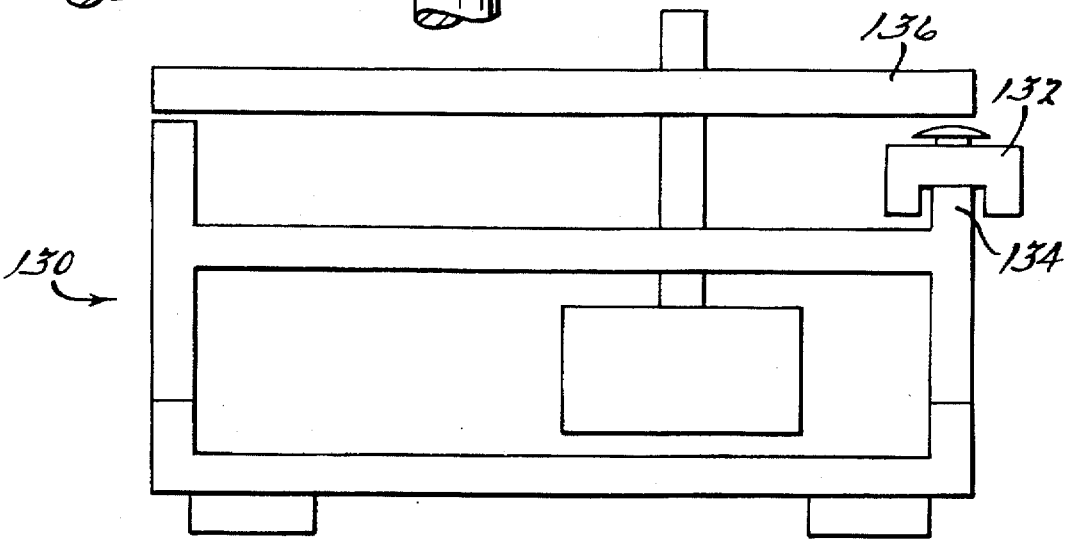

Fig. 9(a).
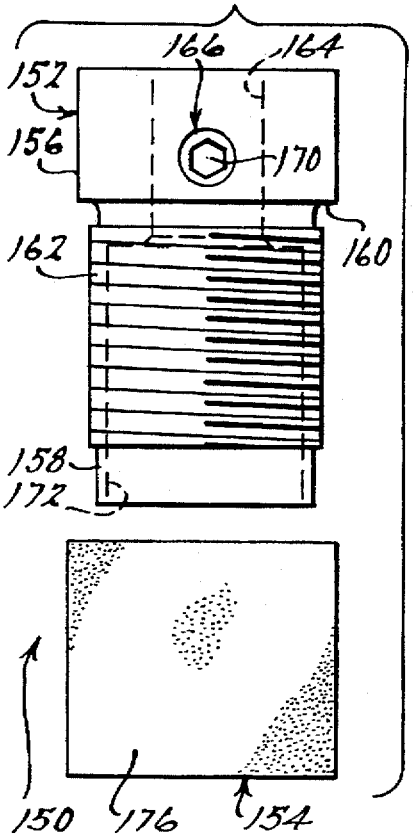
Fig. 9(b).
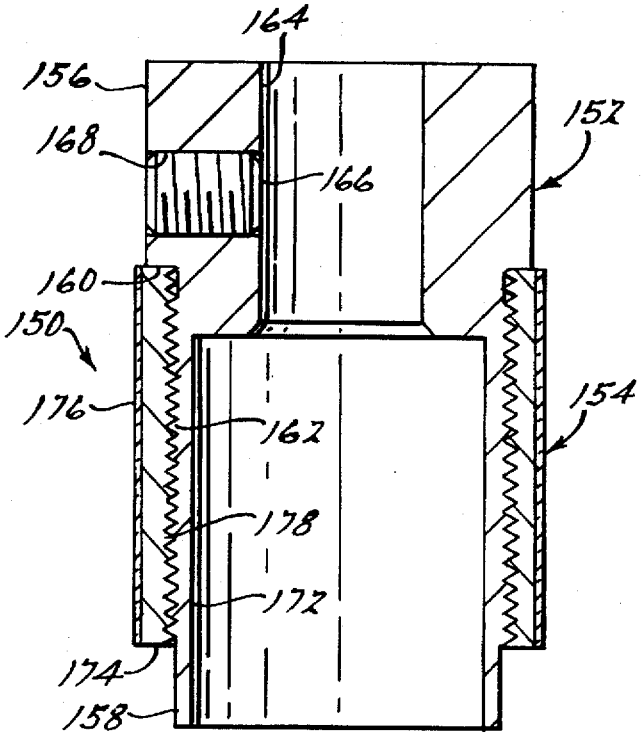
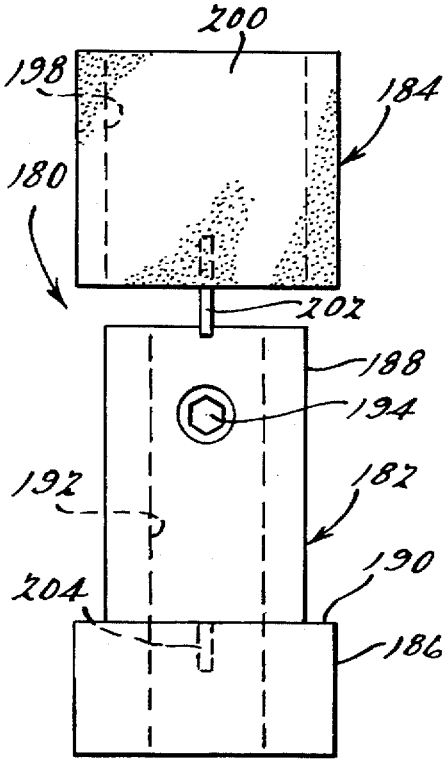
Fig. 10(a).
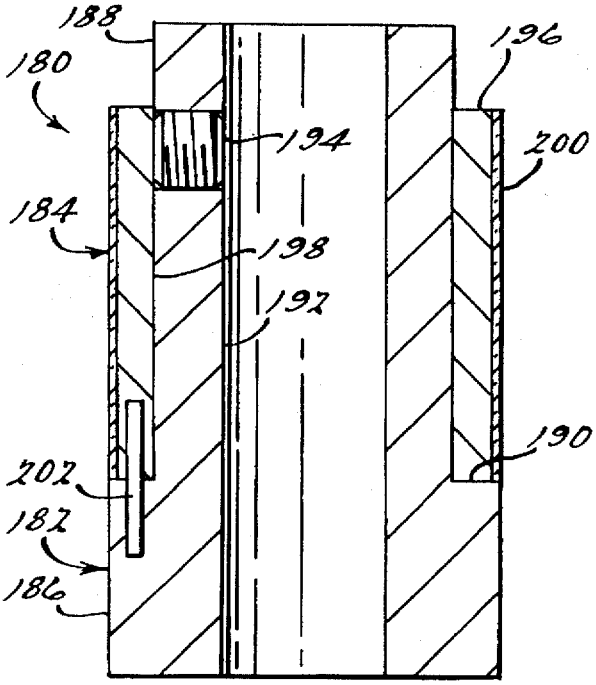
Fig. 10(b).

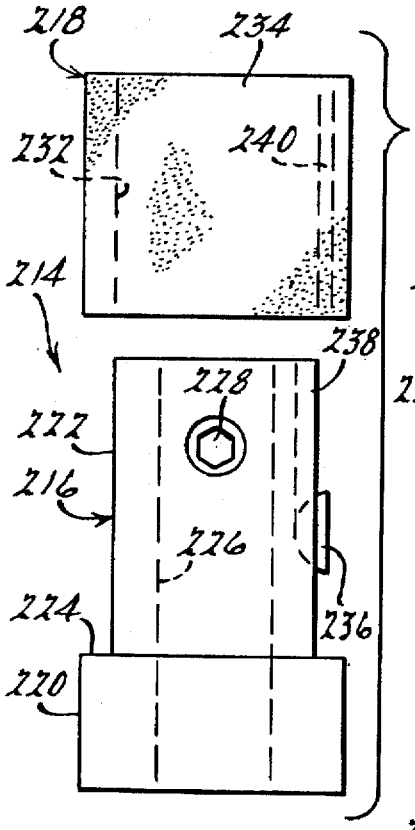
FIG. 11(a).
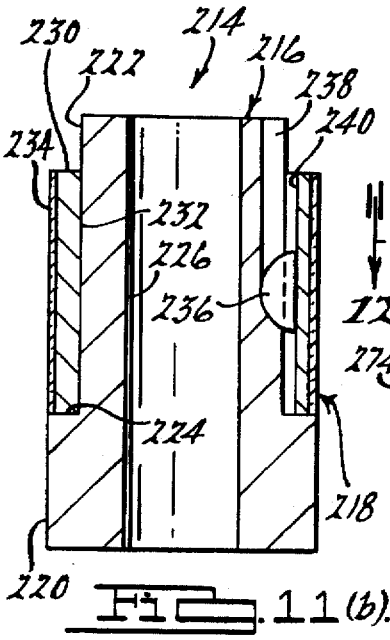
FIG. 11(b).
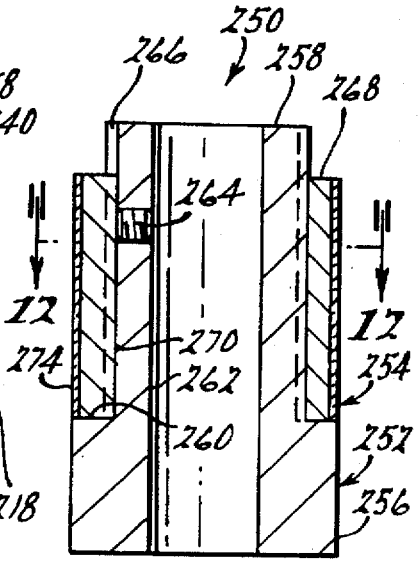
FIG. 12(a).
FIG. 12(b).
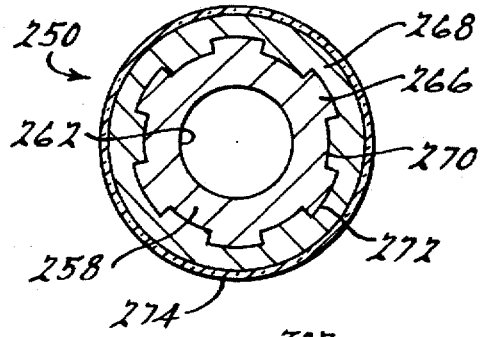
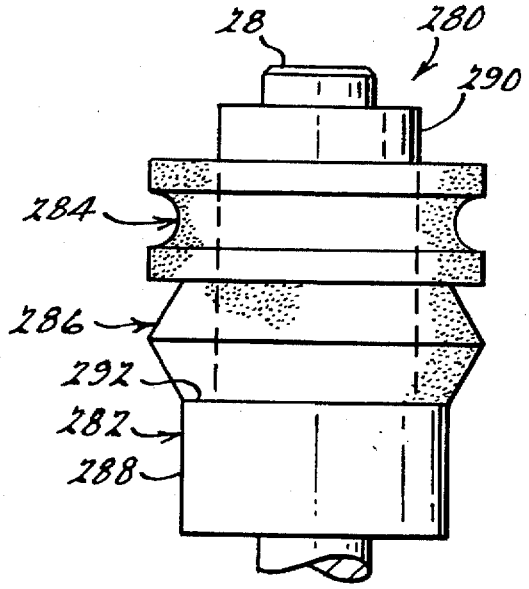
FIG. 13.
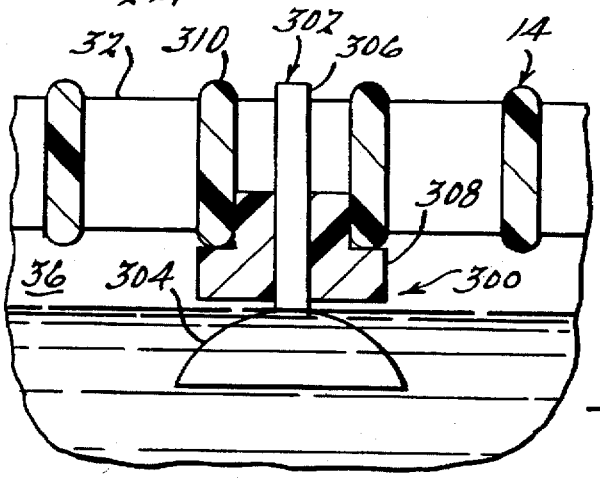
FIG. 14.

DROP-ON GRINDING BIT FOR A GRINDING APPARATUS

CROSS RELATED APPLICATION

This application is a continuation-in-part application of U.S. patent application Ser. No. 08/353,086, filed Dec. 9, 1994, now U.S. Pat. No. 5,586,928, to Wiand et al., which is a continuation-in-part application of U.S. patent application Ser. No. 08/271,135, filed Jul. 6, 1994, now U.S. Pat. No. 5,549,509, to Hirst et al., both being assigned to the assignee of the instant application.

BACKGROUND OF THE INVENTION

The present invention relates generally to grinding machines having a cylindrical grinding wheel mounted on a vertical shaft extending through a horizontal work surface. More particularly, the present invention relates to such grinding machines having an improved work table and grinding wheels.

Grinding machines of the type disclosed herein are typically used for grinding certain work pieces to a particular shape, including, but not limited to, glass, ceramic tile, stone, marble, fiberglass and plastic work pieces. Primarily, the work piece is a piece of stained glass for making stained glass windows. When the work piece is to be ground, the work piece is placed on a work table and manually applied to a grinding wheel that is rotated by an electric motor. Power to the motor is switched on and off during periods of use and non-use of the machine by means of hand or foot operated switches. While these switches are functional, they sometimes distract one's eyes from the work piece. Also, a machine operator may leave the switch on when the machine is not in use resulting in an unsafe condition, and reducing the useful life of the grinding machine. It would be desirable to have a more convenient and efficient means for activating and deactivating the motor.

During the operation of grinding a particular work piece, it is often necessary to change the grinding wheel, for example, to a grinding wheel having a different abrasive grit or abrasive characteristic, or to replace a grinding wheel which has been worn out. Grinding wheels are generally coaxially mounted on a vertical shaft driven by the electric motor and secured in place by means of a set screw or the like. Replacement of the grinding wheel simply involves loosening of the set screw, removing the old wheel, mounting the new wheel and then tightening the set screw on the new wheel. This procedure, while straight forward, is sometimes difficult or unpleasant because of ground glass or other material that has solidified in the area of the set screw. Further, replacement of the entire grinding wheel can be somewhat costly because the entire grinding wheel needs to be replaced as opposed to just replacing the abrasive grinding portion of the grinding wheel. In addition, because the cost of replacing the abrasive grit portions would be lower than replacing the entire grinding wheel, a user could afford a larger variety of sizes and profiles of wheels. Thus, it would be desirable to have a grinding wheel assembly which facilitates changing grinding wheels in which an abrasive grit portion of the grinding wheel was replaced and a remaining core portion of the grinding wheel was reused.

The grinding machines of the type described herein are used to grind work pieces having a wide variety of shapes and sizes. For most commonly used sizes of work pieces a regular sized work table is sufficiently large to support the work piece. However, for large work pieces it would be desirable if an oversized work table were available to be substituted for the regular work table.

The grinding wheels used in association with the grinding machines of the type described herein come in a variety of wheel diameters. Those grinding wheels where the abrasive grit portion is on a side of the grinding wheel have generally been limited to no greater than one inch in diameter because it has heretofore been thought that grinding wheels of a greater diameter having grit portions on the side surface would cause the motor rotating the grinding wheel to bog down during the grinding process. Larger grinding wheels are, however, known in the art, some having diameters of up to six inches, for the type of grinding machines described herein, but the abrasive grit portion of these wheels has been limited to only a top surface of the grinding wheel. In this configuration, the grinding pressure of a workpiece applied to the grinding wheel is in a direction substantially parallel to the shaft of the motor, and therefore the motor would generally not bog down. However, because a larger diameter grinding wheel would provide a greater outside diameter speed for the same motor speed, the grinding rate of such a wheel would be significantly increased. It would therefore be an advantage to have a relatively larger diameter grinding wheel that allowed grinding on a side contoured surface of the grinding wheel, and did not cause the motor to bog down during the grinding process. It would further be an advantage to provide a grinding machine that included a large grinding wheel that allowed grinding on a top surface and a side surface of the wheel and a smaller diameter grinding wheel on the same motor shaft.

The grinding machine of the type described herein generally includes a reservoir beneath the work table of the grinding machine that holds a cooling fluid that acts to cool the grinding wheel and work piece during the process of grinding. Due to evaporation, splashing, and other factors, the cooling fluid is reduced over time to levels that are unacceptable for cooling purposes. Therefore, the reservoir needs to be periodically refilled with new cooling fluid. Because the work table is generally a grate structure, it is applicable to allow the cooling fluid to be poured through the work table into the reservoir. However, a problem exists in that it is not always apparent what the level of cooling fluid is in the reservoir. Therefore, when replacing the cooling fluid, the cooling fluid may overflow the reservoir, or the reservoir may not receive enough cooling fluid. It therefore would be desirable to provide some kind of level indicator of the cooling fluid within the reservoir.

With the above points in mind, we have invented a new and improved grinding apparatus. Accordingly, the apparatus of the present invention has a touch-top work table which enables an operator to turn on the motor by applying slight downward force pressure on the table and to turn off the motor by releasing the downward force on the work table. Also, the work table of the present invention can be easily interchanged with other work tables. Furthermore, the grinding wheel of the present invention facilitates removal of old wheels and installation of new wheels without having to remove the core of the grinding wheel that is secured to the shaft of the electrical motor. Further, a coolant level indicator is provided that provides an indication of cooling fluid in the reservoir.

Further understanding of the present invention will be had from the following detailed description and claims taken in conjunction with the accompanying drawings.

SUMMARY OF THE INVENTION

In accordance with the teaching of the present invention, a drop-on grinding bit of a grinding wheel assembly for a grinding apparatus is disclosed. The grinding wheel assembly is to be mounted on a vertical drive shaft extending from an electric motor through a horizontal work table of the grinding apparatus. The grinding wheel assembly includes a core element that is rigidly secured to the drive shaft. The grinding bit is a cylindrical member having an internal bore that engages with a cylindrical portion of the core element. In one embodiment, a slot formed in the cylindrical portion of the core element mates with a ridge formed on the internal bore of the grinding bit so that as the core element rotates in association with rotation of the drive shaft, the grinding bit also rotates.

Additional objects, advantages and features of the present invention will become apparent from the following description and appended claims taken in conjunction with the accompanying drawings.

BRIEF DESCRIPTION OF THE DRAWINGS

FIG. 4 is a sectional view, broken away, taken along line 4—4 in FIG. 2;

FIG. 5 is an exploded perspective view, broken away, showing the grinding wheel assembly of FIG. 1;

FIG. 6 is a sectional view, broken away, showing an alternative embodiment of grinding wheel assembly of the present invention;

FIG. 7 is a top plan view, with drive shaft in section, of the drive wheel half of FIG. 6;

FIG. 8 is a somewhat schematic side view of an alternative preferred embodiment of a grinding apparatus of the present invention;

FIGS. 9(*a*) and 9(*b*) are an exploded side view and a cross-sectional view, respectively, of a grinding wheel assembly including a core element and a grinding element according to an embodiment of the present invention;

FIGS. 10 (*a*) and 10(*b*) an exploded side view and a cross-sectional view, respectively, of a grinding wheel assembly including a core element and a grinding element according to another embodiment of the present invention;

FIGS. 11(*a*) and 11(*b*) are an exploded side view and a cross-sectional view, respectively, of a grinding wheel assembly including a core element and a grinding element according to another embodiment of the present invention;

FIGS. 12(*a*) and 12(*b*) are a cross-sectional view and a top view, respectively, of a grinding wheel assembly including a core element and a grinding element according to another embodiment of the present invention;

FIG. 13 is a side view of a grinding wheel assembly including two different types of grinding wheel elements according to a preferred embodiment of the present invention;

FIG. 14 is a cutaway side view showing a section of a reservoir and work table, and a coolant level indicator within the reservoir according to an embodiment of the present invention;

DETAILED DESCRIPTION OF THE PREFERRED EMBODIMENT

Figure 1:
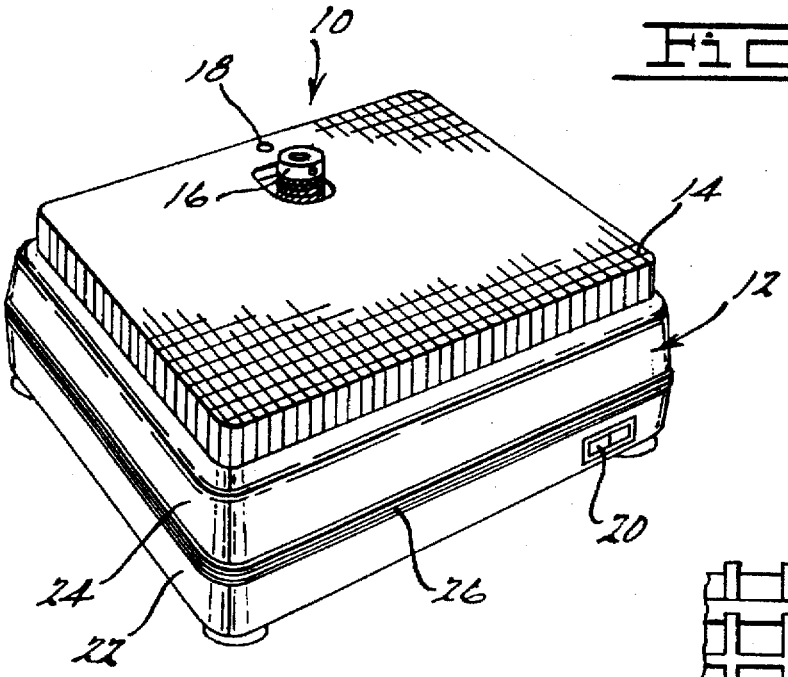
FIG. 1 is a perspective view of a preferred embodiment of a grinding apparatus of the present invention.
Figure 2:
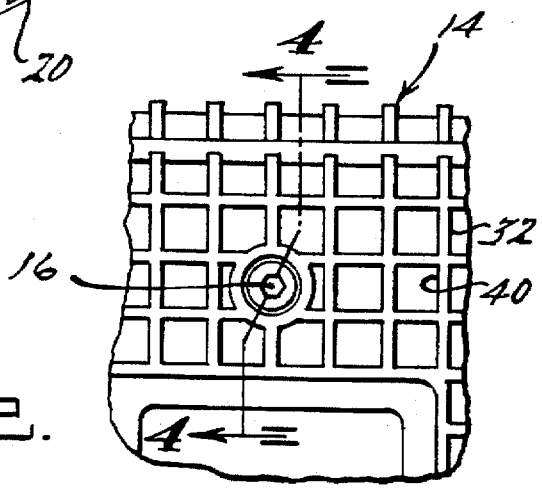
FIG. 2 is a plan view, broken away, showing the grinding wheel assembly of the apparatus of FIG. 1.
Figure 3:
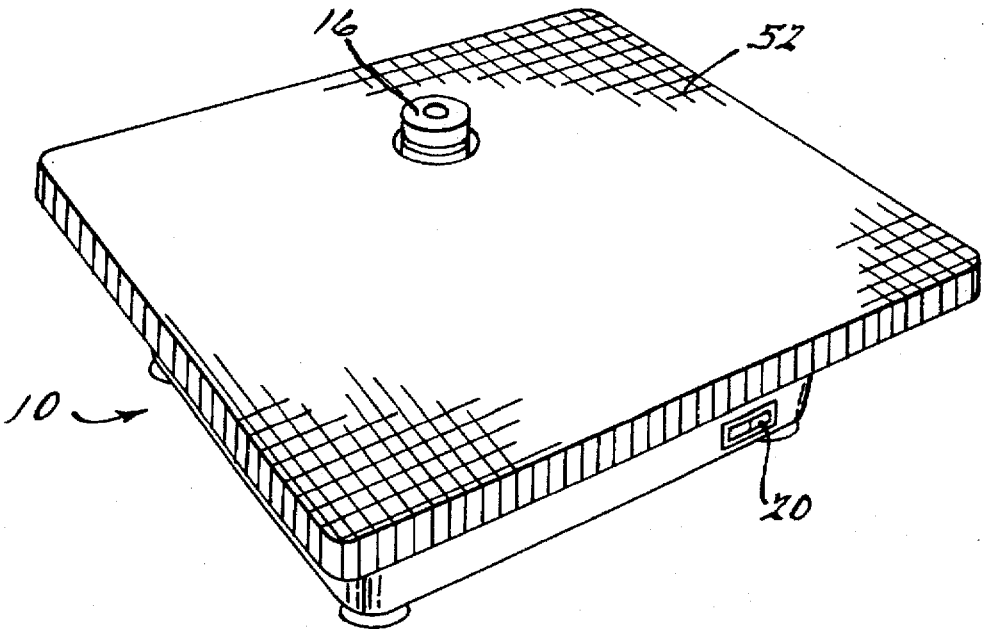
FIG. 3 is a perspective view showing a preferred embodiment of the present invention an oversized work table.

The following discussion of the preferred embodiments concerning a grinding apparatus and associated grinding wheel assemblies is merely exemplary in nature, and is in no way intended to limit the invention or its applications or uses.

Referring to FIGS. 1–5, a preferred embodiment of a grinding apparatus of the present invention is shown. The grinding apparatus 10 comprises a housing 12, a work table 14, a grinding wheel assembly 16, a pressure sensitive switch 18 and a three position electrical switch 20. The electrical switches 18 and 20 are in electrical communication with an electrical power source (not shown) and an electric motor (not shown).

The housing 12 is made of molded thermoplastic material and comprises two half shells 22 and 24 secured together by an elastomeric band 26 positioned therebetween. The electric motor is supported within the housing 12 in a conventional manner and has a drive shaft 28 which rotates to drive the grinding wheel assembly 16. Thus, when the electric motor is switched "on", the drive shaft 28 rotates to rotate the grinding wheel assembly 16.

The work table 14 is also made of molded thermoplastic material and has two parts, a flat screen 32 and a base 34. The base 34 is a rectangular pan which provides a reservoir 36 for retaining coolant water. The screen 32 provides a work surface 38 for supporting work pieces to be ground. The screen 32 includes a plurality of open holes or spaces 40 which allow liquid coolant and small solids to fall into the reservoir 36. The screen 32 has an opening through which the grinding wheel assembly 16 freely extends. The peripheral edges of the screen 32 are supported by a peripherally extending shoulder 42 on the side walls of the base 34. The work table 14 is supported on a flat upper wall 44 of the housing 12 and is maintained in position by a lip 46. The lip 46 extends around the under surface perimeter of the work table 14 and overlaps a corresponding ridge 48 in a top wall 50 of the housing 12. Larger sizes of work tables can easily be interchanged with the work table 14 as is illustrated by a work table 52 in FIG. 3.

As is best shown in FIG. 4, an isolation wall 54 separates the reservoir 36 and provides a dry compartment 56 within the base 34. Disposed partially within the dry compartment 56 is the pressure switch 18 for activating the electric motor which drives the grinding wheel assembly 16. The pressure switch 18 is secured in the top wall 58 of the housing 12 and extends upwardly therefrom into the dry compartment 56 of the base 34 of the work table 14. A cup shaped member 60 is coaxially disposed over a cylindrically shaped wall 62 and threadably carries an adjustment screw 64. As is shown in FIG. 4, an end 66 of the adjustment screw 64 is supported by a rod 68 of the pressure switch 18 which is spring biased upwardly. Thus, one side edge 70 of the work table 14 is normally lifted slightly upwardly by the pressure switch 18. When sufficient downward force is applied to the work surface 38 proximate to the edge 70 thereof to overcome the spring bias of the pressure switch 18, then the edge 70 of the work table 16 will move downwardly and the switch 18 will be activated to apply electrical power to the motor.

The switches 18 and 20 will be connected between the power source and the motor so that the switch 20 can be placed in a first, "off" position to prevent operation of the motor even if the switch 18 is activated, a second position to provide operation of the motor only when the switch 18 is activated and a third position to operate the motor regardless of the position of the switch 18. A schematic is not shown as this circuitry is well within the skill of one of the art.

Referring to FIG. 5, the grinding wheel assembly 16 is well illustrated. The grinding wheel assembly 16 is shown in operative association with the drive shaft 28. The grinding wheel assembly 16 comprises a pair of cylindrically shaped elements including a drive half 74 and a grinding wheel 76. The drive half 74 has a cylindrically shaped bore 78 through which the drive shaft 28 closely, but slidably, extends. In addition, the drive half 74 has a bore of a larger diameter 80 which provides a skirt 82 to minimize coolant water splashing. A set screw 84 is used to secure the drive half 74 to the shaft 28. The top surface of the drive half 74 has a shoulder 86 adapted to cooperate with a corresponding shoulder 88 in the grinding wheel half 76 to drive the grinding wheel half 76. The grinding wheel half 76 has a surface of suitable abrasive grit, such as diamond abrasive grit 90. The grinding wheel half 76 has a bore 92 which is adapted to closely, but slidably, fit over the drive shaft 28. Thus, to change grinding wheels one can grasp the grinding wheel half 76 and lift it upwardly off of the shaft 28, and then replace it with a different grinding wheel half on the shaft 28 against the drive half 74.

Now referring to FIGS. 6 and 7, an alternative embodiment of a grinding wheel assembly is shown and indicated generally by the numeral 98. The grinding wheel assembly 98 has a drive half 100 and a grinding wheel half 102. The drive half 100 is of a construction analogous to the drive half 74 but has a projection 104 in its upper surface which as viewed in FIG. 7 has a hexagon shape to provide a plurality of shoulders 106 for driving the grinding wheel half 102. The grinding wheel half 102 has a corresponding shaped recess which cooperates with the projection 104.

Now referring to FIG. 8, a retrofit kit for adapting a grinding apparatus to provide a touch-top work table which can operate an electric motor in a manner similar to the apparatus of FIG. 1 is shown. Thus, a grinding apparatus 130 has a pressure switch 132 inserted between a wall 134 and a work table 136. The pressure switch 132 is electrically inserted between a motor 138 and a power source such that upon the closing of the pressure switch 132 by moving the work table 136 downwardly, the motor 138 will operate.

As discussed above, grinding wheels of the type used in association with the grinding apparatus 10 have heretofore been single units that are secured to the shaft 28 by a set screw or the like. Because the type of grinding apparatus discussed above is generally used by hobbyists, the cost of the grinding wheels has been such to limit the ability of the hobbyist to purchase as many of the different types of wheels that are available. In order to at least limit the cost of the grinding wheel applicable to be used in the grinding apparatus 10, this invention proposes a type of grinding wheel assembly that includes a permanent core element that is secured to the shaft 28, and a separate grinding element that is of less cost and is replaceable with other grinding elements to be secured on the core element. Further, the separate grinding element enables a diamond abrasive grit layer to be electroplated to the grinding element more rapidly as a result of more current being generated because there is less metal.

FIGS. 9(*a*) and 9(*b*) show an exploded side view and a cross-sectional side view, respectively, of a grinding wheel assembly 150 according to one embodiment of the present invention. The grinding wheel assembly 150 includes a cylindrical core element 152 and a cylindrical grinding element 154. The core element 152 is typically made of brass and includes an upper cylindrical portion 156 of one diameter and a lower cylindrical portion 158 of a lesser diameter so as to define a shoulder 160 therebetween. The lower portion 158 includes a threaded portion 162 that does not extend to the shoulder 160 as shown. The upper portion 156 includes a cylindrical bore 164 that is of the appropriate diameter to accept the shaft 28 in a slidable friction fit. The lower portion 158 includes an internal bore 172 having a greater diameter than that of the bore 164. The core element 152 is secured to the shaft 28 by a set screw 166 extending through a bore 168 in a wall of the upper portion 156. A head 170 of the set screw 166 is accessible to allow the set screw 166 to be tightened against the shaft 28, in a manner that is well understood in the art, so as to secure the core element 152 to the shaft 28.

The grinding element 154 is cylindrical in nature and includes a brass base portion 174 on which is electroplated a thin layer 176 of a diamond abrasive grit by a process that is well understood in the art. The base portion 172 includes internal threads 178 that are threadably engageable with the threaded portion 162 on the lower portion 158 of the core element 152. The grinding element 154 is threaded onto the threaded portion 162 of the core element 152 until an upper edge of the grinding element 154 contacts the shoulder 160. Because the threaded portion 162 does not extend to the shoulder 160, the grinding element 154 is not able to be overly tightened on the core element 152. Further, the threaded portion 162 is a reverse thread so that the grinding element 154 does not come unthreaded from the core element 152 when the shaft 28 rotates. Once the abrasive grit layer 172 has been deteriorated by use to a level where it is ineffective for grinding purposes or where a user wishes to change grinding elements, the grinding element 154 can be unthreaded from the core element 152 and replaced with a new grinding element. Therefore, the cost associated with buying an entire new grinding assembly is eliminated because the core element 152 can be reused. It is noted that the upper portion 156 is above the lower portion 158 when the grinding wheel assembly 150 is positioned on the shaft 28. However, it is completely within the scope of the invention to have the larger diameter upper portion 156 be below the lesser diameter lower portion 158 when the grinding wheel assembly 150 is positioned on the shaft 28 such that the grinding element 154 can be removed from the core element 152 while the core element 152 remains secured to the shaft 28.

The threadable engagement between the core element 152 and the grinding element 154 is one example of how the grinding element 154 can be replaced with a new grinding element. What is important to this concept is that the grinding element 154 is able to rotate in association with the core element 152 as the shaft 28 rotates and be readily removable from the core element 152. FIGS. 10(*a*) and 10(*b*) show an exploded view and a cross-sectional side view, respectively, of a grinding wheel assembly 180 according to an alternate embodiment of the present invention. In this embodiment, the grinding wheel assembly 180 includes a cylindrical brass core element 182 and a cylindrical grinding element 184. The core element 182 includes a lower cylindrical base portion 186 having one diameter and an upper cylindrical portion 188 having a smaller diameter than the lower cylindrical portion 186 so as to define a shoulder 190 therebetween. The core element 182 includes an internal cylindrical bore 192 that accepts the shaft 28 in a slidable friction engagement. A set screw 194 extends through a wall of the upper portion 188 of the core element 182 so as to allow the core element 182 to be secured to the shaft 28 in the same manner that the core element 152 was secured to the shaft 28 as discussed above. Therefore, by tightening the set screw 194 to the shaft 28, the core element 182 will rotate with the shaft 28.

The grinding element 184 includes a cylindrical base portion 196 defining an internal cylindrical bore 198. A thin layer 200 of an abrasive diamond grit is electroplated to an outer surface of the base portion 196 in a manner that is well understood in the art. The diameter of the cylindrical bore 198 is of such a dimension that the grinding element 184 is slidably engageable with the upper cylindrical portion 188 of the core element 182 as shown in FIG. 10(*b*). The grinding element 184 rests on the shoulder 190 and covers the set screw 194. The thickness of the combination of the base portion 196 and the abrasive grit layer 200 is substantially equal to the difference of the diameter upper cylindrical portion 188 and the lower cylindrical portion 186 as shown.

In order to allow the grinding element 184 to rotate with the core element 182 as the shaft 28 rotates, the grinding element 184 is provided with a pin 202 that is frictionally slidably engageable within a cylindrical opening 204 extending into the lower portion 186 through the shoulder 190, as shown. The pin 202 is rigidly secured within the base portion 196 of the grinding element 184 by any appropriate mechanism such as by a friction pressure fit. Therefore, the grinding element 184 is forced to rotate with the rotation of the core element 182.

FIGS. 11(*a*) and 11(*b*) show yet another alternate embodiment of the present invention for providing a replaceable grinding element. FIG. 11(*a*) shows an exploded view of a grinding wheel assembly 214 and FIG. 11(*b*) shows a cross-sectional view of the grinding wheel assembly 214. In this embodiment, the grinding wheel assembly 214 includes a cylindrical brass core element 216 and a cylindrical grinding element 218. The core element 216 includes a lower cylindrical base portion 220 having one diameter and an upper cylindrical portion 222 having a smaller diameter than the lower cylindrical portion 220 so as to define a shoulder 224 therebetween. The core element 216 includes an internal cylindrical bore 226 that accepts the shaft 28 in a slidable friction engagement. A set screw 228 extends through a wall of the upper cylindrical portion 222 and contacts the shaft 28 so as to secure the core element 216 to the shaft 28 in the same manner that the set screw 166 secures the core element 152 to the shaft 28.

The grinding element 218 includes a base portion 230 defining an internal cylindrical bore 232. A thin layer 234 of an abrasive diamond grit is electroplated to an outer surface of the base portion 230 in a manner that is well understood in the art. The base portion 230 of the grinding element 218 is slidably engageable on the upper cylindrical portion 222 in a friction type engagement and rests on the shoulder 224, as shown. The thickness of the combination of the base portion 230 and the abrasive grit layer 234 is substantially equal to the difference between the diameter of the upper cylindrical portion 222 and the lower cylindrical portion 220 as shown.

In order to allow the grinding element 218 to rotate with the core element 216 as the shaft 28 rotates, the core element 216 is provided with a half-moon shaped key element 236 that rests within a slot 238 formed in a wall of the upper cylindrical portion 222 of the core element 216 such that a portion of the key element 236 extends beyond the wall as shown. An internal wall of the base portion 230 is provided with a slot 240 such that when the grinding element 218 is appropriately aligned with the core element 216, the portion of the key element 236 that extends beyond the wall of the upper portion 222 will engage the slot 240 in the grinding element 218. Therefore, the grinding element 218 is forced to rotate with the rotation of the core element 216.

FIGS. 12(*a*) and 12(*b*) show yet another embodiment of the present invention for providing a replaceable grinding element. FIG. 12(*a*) shows a cross-sectional side view of a grinding wheel assembly 250 and FIG. 12(*b*) shows a cross-sectional top view along line 12—12 of the grinding wheel assembly 250. In this embodiment, the grinding wheel assembly 250 includes a cylindrical brass core element 252 and a cylindrical grinding element 254. The core element 252 includes a lower cylindrical base portion 256 having one diameter and an upper cylindrical portion 258 having a smaller diameter than the lower cylindrical portion 256 so as to define a shoulder 260 therebetween. The core element 252 includes an internal cylindrical bore 262 that accepts the shaft 28 in a slidable friction engagement. A set screw 264 extends through an opening in the upper portion 258 of the core element 252 so as to secure the core element 252 to the shaft 28 in the same manner that the set screw 166 secures the core element 152 to the shaft 28 as discussed above. Therefore, by tightening the set screw 264 to the shaft 28, the core element 252 will rotate the shaft 28. The upper portion 258 of the core element 252 includes a series of projections 266, shown here as six projections, that extend along the entire length of the upper portion 258.

The grinding element 254 includes a base portion 268 defining an internal bore 270. The internal bore 270 includes a series of indented sections 272 that are configured substantially identical to the projections 266. A thin layer 274 of an abrasive diamond grit is electroplated to an outer surface of the base portion 268 in a manner that is well understood in the art. By appropriately aligning the grinding element 254 with the upper portion 258 of the core element 252, the projections 266 will engage the indentations 272 so as to allow the grinding element 268 to slidably engage the core element 252 in a friction type arrangement. Therefore, as the shaft 28 rotates, the set screw 264 will cause the core element 252 to rotate, and the series of projections 266 and indentations 272 will cause the grinding element 254 to rotate. The thickness of the combination of the base portion 268 and the diamond grit layer 274 is substantially equal to the difference in the diameter of the upper cylindrical portion 258 and the lower cylindrical portion 256 as shown. When the grinding element 268 is slidably engaged with the core element 252, the grinding element 254 will rest on the shoulder 260.

The combination of projections 266 and indented sections 272 that allow the grinding element 254 to be locked to the core element 252 is one type of configuration for the purpose described herein. Of course, other types of projections and indentations on the exterior surface of the upper portion of the core element and the interior surface of the grinding element can provide other locking arrangements. For example, the upper portion 258 of the core element 252 could include a series of shoulders, such as the shoulders 106 discussed above, and the grinding element 254 could have corresponding recesses.

FIG. 13 shows a side view of a grinding wheel assembly 280 that includes a cylindrical brass core element 282 and two grinding elements 284 and 286. The core element 282 includes a lower portion 288 and an upper portion 290. The upper portion 290 is of a smaller diameter than the lower portion 288 so as to define a shoulder 292 therebetween. The two grinding elements 284 and 286 include internal bores that are the same dimension as the cylindrical upper portion 290 such that the grinding elements 284 and 286 are slidably engageable onto the upper portion 290 of the core element 288 in a friction type engagement, and rest on the shoulder 292, as shown. The core element 282 further includes an internal bore for accepting the shaft 28 in a slidable friction engagement. A mechanism, such as a set screw (not shown), is adaptable to secure the core element 282 to the shaft 28 in the same manner as discussed above.

The purpose of this figure is to show that the core elements discussed above are applicable to accept different numbers of grinding elements. In other words, each of the different embodiments discussed above for allowing the grinding element to rotate with the core element can also be used to provide rotation of different numbers of grinding elements on a single core element. In this example, the grinding element 284 is a lamp bit, and the grinding element 286 is a ripple bit, both well known to those skilled in the art. Of course other types of bits, such as speed bits and fine bits, are also applicable to replace the bits 284 and 288. What is important in FIG. 13 is that the core element 282 can accept a plurality of different types of bits that are suitably dimensioned. Of course, other numbers of bits that are of the appropriate dimension can replace the bits 284 and 286. In this example, the combination of the bits 284 and 286 are approximately equal to the length of one of the grinding elements discussed above.

FIG. 14 shows a cutaway side view of a float assembly 300 applicable to be used in associated with the grinding apparatus 10. The float assembly 300 includes a float 302 that includes a bottom dome portion 304 connected to an upper elongated portion 306. The elongated portion 306 extends through a stabilizing element 308 in a slidable friction engagement. The stabilizing element 308 is secured to a section of the work table 14. The stabilizing element 308 is secured to adjacent screen sections 310 of the work table 14 by a suitable connecting mechanism, such as glue. In this configuration, the elongated portion 306 extends between screen sections 310 of the screen 32 of the work surface 14. The bottom dome portion 304 is positioned within the reservoir 36 and is adaptable to float on the coolant water in the reservoir 36. Therefore, as the float 302 moves in association with the differing levels of coolant water within the reservoir 36, the elongated portion 306 will move up and down through the work table 14. Therefore, one can fill the reservoir with the appropriate cooling fluid to a level that indicates that the reservoir is full when the tip of the elongated portion 306 extends out of the work table 14. In one embodiment, the float 302 and the stabilizing element 308 are molded plastic pieces.

Figure 15:
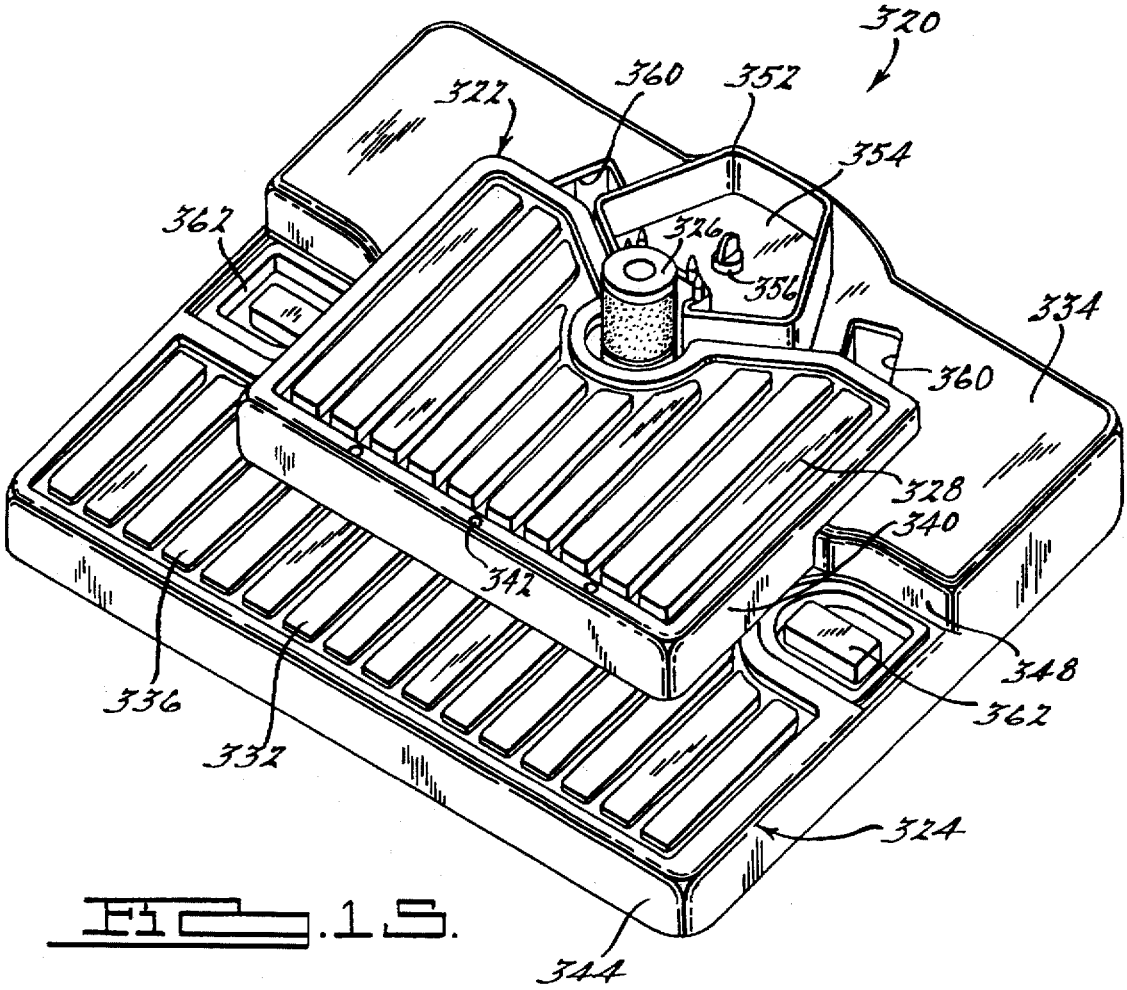
FIG. 15 as a perspective view of a work table configured to be secured to a grinding machine according to an embodiment of the present invention.
Figure 16:
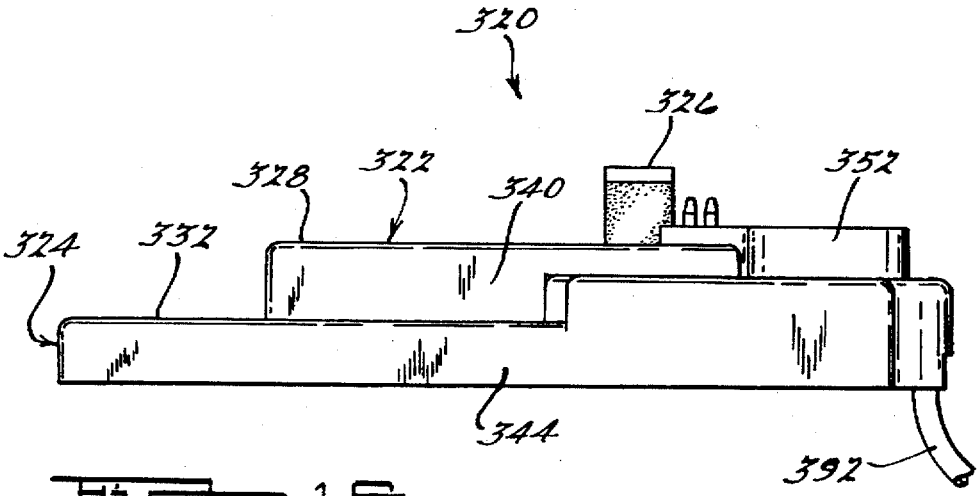
FIG. 16 is a side view of the work table of FIG. 15.

FIGS. 15–18 show a number of different views of a work table 320 according to another embodiment of the present invention. FIG. 15 is a perspective view and FIG. 16 is a side view of the work table 320 as it appears completely assembled. The work table 320 is interchangeable with the work table 14 on the grinding apparatus 10 in the same manner that the work table 52 is interchangeable with the work table 14. In one embodiment the different pieces of the work table 320 discussed below are molded plastic.

Figure 17:
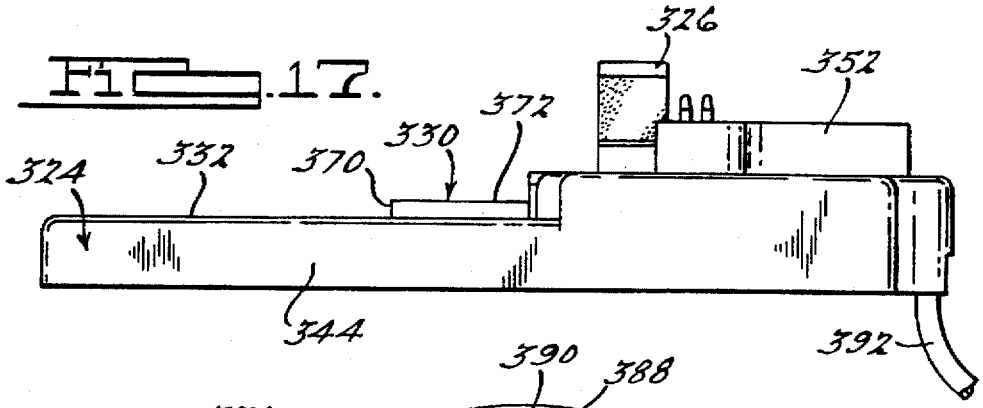
FIG. 17 is a side view of the work table of FIG. 15 where an upper work table portion has been removed to expose a large diameter grinding wheel.
Figure 18:
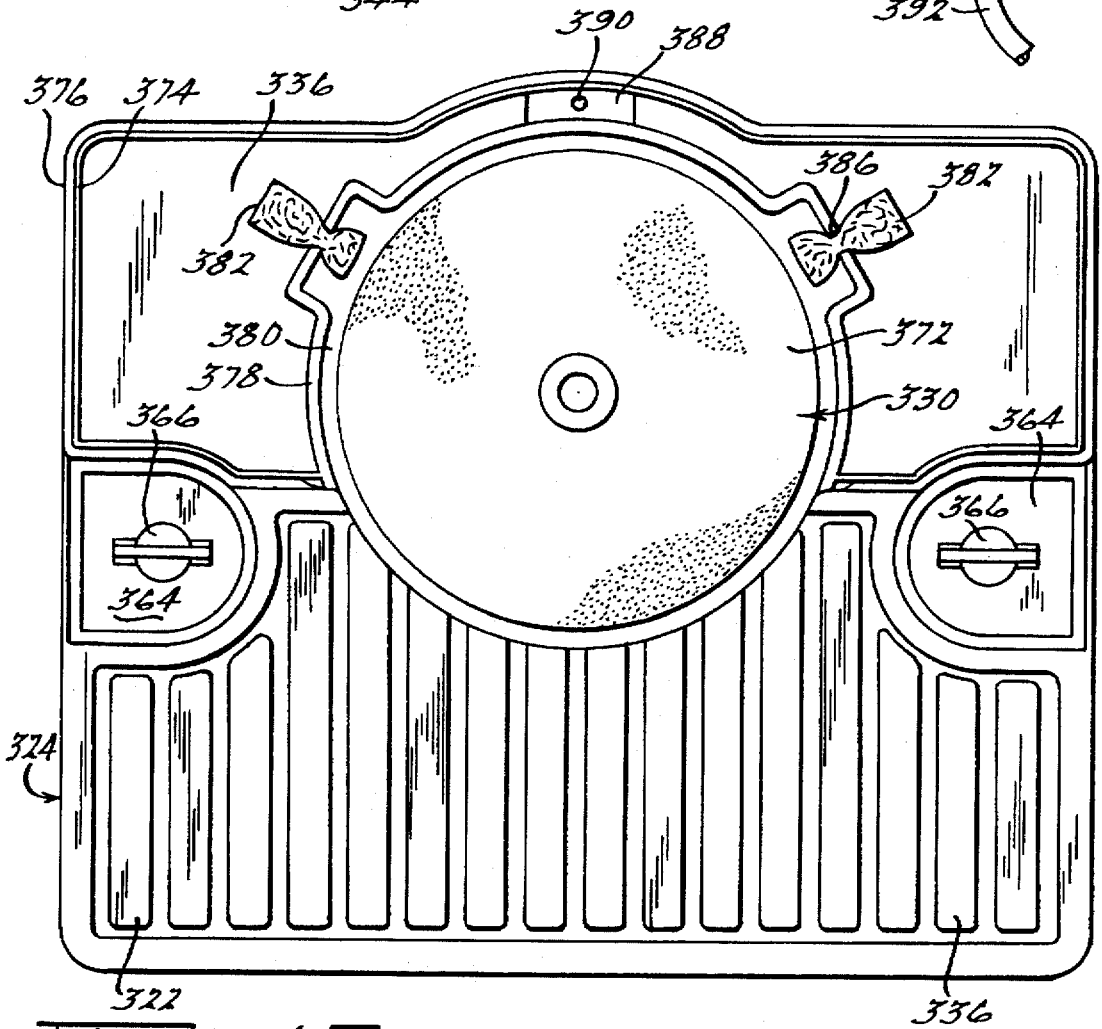
FIG. 18 is a top view of the work table as shown in FIG. 17.

As will be discussed in more detail below, the work table 320 includes a removable upper work table portion 322 and a lower work table portion 324 so as to allow a user to grind a work piece (not shown) on a relatively small diameter (about one inch or less) grinding wheel 326 when the work piece rests on a work surface 328 of the upper work table portion 322, and on a relatively larger diameter grinding wheel 330 (see FIG. 18) when the work piece rests on a work surface 332 of the lower work table portion 324. A removable platform 334 covers a main reservoir 336 (see FIG. 18), and is positioned at a intermediate level between the level of the upper work table portion 322 and the level of the lower work table portion 324. The work surface 328 and the work surface 332 each include a series of parallel raised ribs 336, as shown. FIG. 17 shows a side view of the work table 320 when the upper work table portion 322 has been removed, and FIG. 18 shows a top view of the work table 320 when the upper work table portion 322 and the platform 334 have been removed. Although the grinding wheels 326 and 328 are shown relative to the work table 320, it will be understood that the grinding wheels 326 and 328 will be coaxially aligned and secured to the drive shaft 28 when in the position as shown when the work table 320 is secured to the grinding apparatus 10.

As is apparent, the upper work table portion 322 rests on the lower work table portion 324 at one end of the upper portion 322 and rests on the platform 334 at an opposite end of the upper portion 322. When the upper portion 322 is positioned on the work table 320, it covers the grinding wheel 330. A stepped wall 340 allows the upper work table portion 322 to be appropriately positioned relative to the lower work table portion 324 and the platform 334. In one embodiment, when the work table 320 is connected to the grinding apparatus 10, the work surface 328 of the upper work table portion 322 has a slight slant away from the grinding wheel 326 so as to allow cooling fluid and the like to flow down the work surface 328 of the upper work table portion 322 between the ribs 336 and drain into orifices 342 through the work surface 328 onto the work surface 332 of the lower work table portion 324. A wall 344 defines the height of the work surface 332 of the lower work table portion 324, and a wall 348 defines the distance of the platform 334 above the work surface 332 of the lower work table portion 324.

A wall 352 extending from the top of the platform 334 defines a reservoir 354 that collects cooling fluid during a grinding process on the grinding wheel 326. A rotatable valve 356 positioned within the reservoir 354 allows cooling fluid to drip from the reservoir 354 onto a top surface of the grinding wheel 330. The valve 356 can be regulated to control the amount of fluid that drips from the reservoir 354. Tab members (not shown) extend from a bottom surface of the upper portion 322 to engage a pair of openings 360 that extend through the platform 334 so as to position the upper portion 322 in place on the lower portion 324 and the platform 334. The openings 360 allow cooling fluid to be poured into the reservoir 336 below the platform 334. First and second cap members 362 cover openings 364 in the lower work table portion 324 to prevent cooling fluid and the like from gaining access to the openings 364. Disposed within each opening 364 is a rotatable tab member 366 that secures the work table 320 to the grinding apparatus 10. The tab members 366 engage appropriately configured openings (not shown) within a top surface (not shown) of the grinding apparatus 10 so as to rigidly secure the work table 320 at the appropriate location on the grinding apparatus 10.

By removing the upper work table portion 322, the grinding wheel 330 is exposed to allow grinding of a work piece against the grinding wheel 330 relative to the work surface 328 of the lower work table portion 324. In a preferred embodiment, the grinding wheel 328 is secured to the drive shaft 28 of the motor at an appropriate location such that a side surface 370 of the grinding wheel 330 extends above the work surface 332 of the lower portion 324. In this configuration, a user can grind a work piece against the side surface 370 of the grinding wheel 330 to grind appropriately dimensioned contours of the work piece. Likewise, the user can use a circular top surface 372 of the grinding wheel 330 to grind flat surfaces of the work piece.

Specifically looking at FIG. 18, the platform 334 rests in a lip 374 that runs around the top perimeter of a wall 376 defining the reservoir 336. A wall 378 defines a region 380 that the grinding wheel 330 rotates within. A pair of sponges 382 are secured within openings 386 in the wall 378 in an adjustable manner so that they can be moved in contact with the grinding wheel 330 so as to bring cooling fluids within the reservoir 334 to the wheel 330 in a controlled manner. Because it is important to maintain a maximum level of cooling fluid within the reservoir 334 to reduce splashing and the like, a raised section 388 is provided within the reservoir 334. An opening 390 through the raised section 388 allows cooling fluid that comes above the raised section 388 to be drained from the reservoir 334 through a tube 392.

Figure 19:
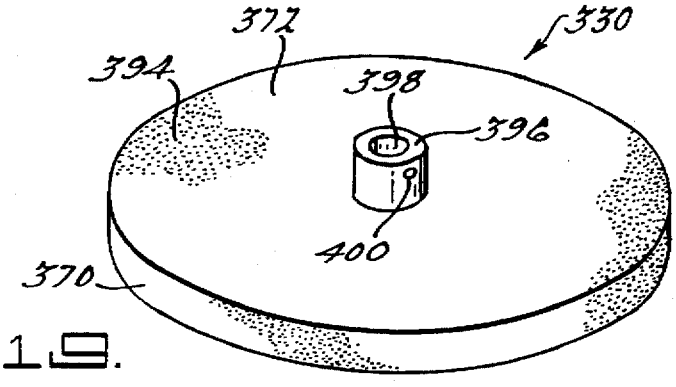
FIG. 19 is a perspective view of the large diameter grinding wheel shown in FIG. 18.

FIG. 19 shows a perspective view of the grinding wheel 330. As is apparent, the grinding wheel 330 is a cylindrical member defined by the circular top surface 372 and the side 370. Both the top surface 372 and the side surface 370 include an abrasive grit layer 394, preferably diamond grit electroplated on a steel member. A center cylindrical member 396 secured to the top surface 372 includes a central bore 398 that accepts the shaft 28. A set screw 400 secures the grinding wheel 330 to the shaft 28 at a desirable location on the shaft 26. In a preferred embodiment, the diameter of the grinding wheel 330 is in the range of about four inches to about six inches. However, it will be appreciated by those skilled in the art that the grinding wheel 330 can have any diameter appropriate for the purposes described herein. Because the abrasive grit layer 394 is on both the top surface 372 and the side surface 370, the grinding wheel 330 facilitates grinding of a work piece on both of these surfaces.

Figure 20A:
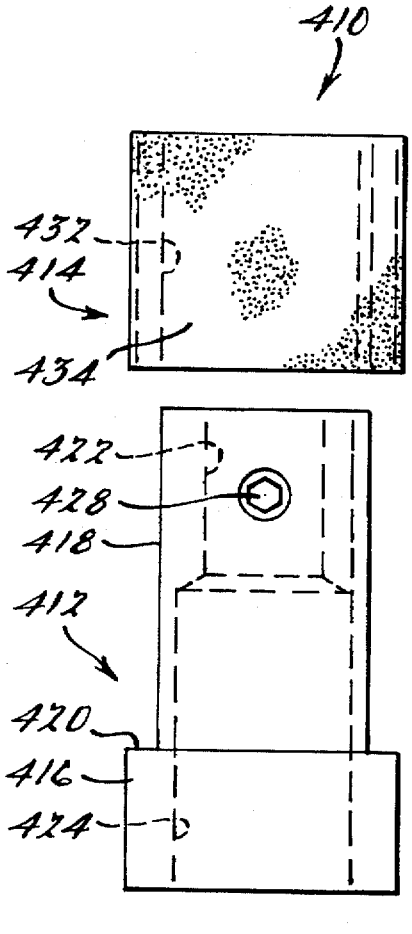
FIGS. 20(*a*), 20(*b*) and 20(*c*) are an exploded side view, cross-sectional view, and top view, respectively, of a grinding wheel assembly including a core element and a grinding bit element according to an embodiment of the present invention.
Figure 20B:
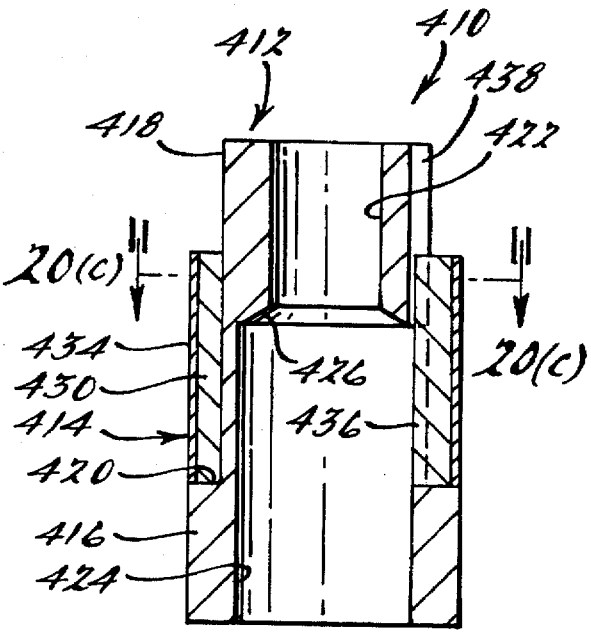
Figure 20C:
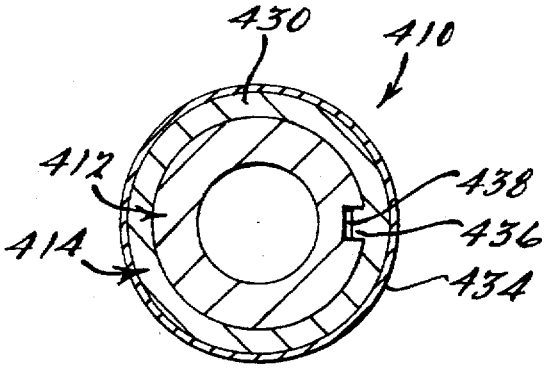

FIGS. 20(*a*), 20(*b*) and 20(*c*) show an exploded view, a cross-sectional side view, and a top view, respectively, of a grinding wheel assembly 410 according to yet another embodiment of the present invention. In this embodiment, the grinding wheel assembly 410 includes a cylindrical brass core element 412 and a cylindrical grinding bit element 414. The core element 412 includes a lower cylindrical base portion 416 having one outer diameter and an upper cylindrical portion 418 having a smaller outer diameter than the cylindrical portion 416 so as to define a shoulder 420 therebetween. The core element 412 further includes an upper internal cylindrical bore 422 that accepts the shaft 28 in a slidable friction engagement. The core element 412 also includes a lower internal cylindrical bore 424 having a larger inner diameter than the inner diameter of the cylindrical bore 422, such that a shoulder 426 is defined between the upper cylindrical bore 422 and the lower cylindrical bore 424. A set screw 428 extends through a wall of the upper cylindrical portion 418 of the core element 412 into the bore 422 so as to allow the core element 412 to be secured to the shaft 28 in the same manner as discussed above with the other grinding bit assembly embodiments. Therefore, by tightening the set screw 428 to the shaft 28, the core element 412 will rotate with the shaft 28.

The grinding bit element 414 includes a cylindrical base portion 430 defining an internal cylindrical bore 432. A thin layer 434 of an abrasive diamond grit is electroplated to an outer surface of the base portion 430 in a manner that is well understood in the art. The diamond abrasive grit layer 434 offers one type of abrasive grit. As will be appreciated by those skilled in the art, other abrasive grits, as well as other techniques, such as brazing, of securing the grits to the base portion 430, are within the scope of the present invention. The diameter of the cylindrical bore 432 is of such a dimension that the grinding element 414 is slidably engageable with the upper cylindrical portion 418 of the core element 412 as shown in FIG. 20(*b*). In this configuration, the grinding bit element 414 rests on the shoulder 420 and may cover the set screw 428. In the embodiment as shown, the grinding bit element 414 has a length that is less than the length of the upper cylindrical portion 418. In this manner, the core element 412 can accommodate many different grinding elements of differing lengths. Also, the thickness of the combination of the base portion 430 and the abrasive grit layer 434 is substantially equal to the difference between the diameter of the upper cylindrical portion 418 and the lower cylindrical portion 416, as shown. However, the thickness of the combination of the base portion 430 and the abrasive grit layer 434 does not have to be this dimension, and can be greater or less than the difference between the diameter of the upper cylindrical portion 418 and the lower portion 416.

In order to allow the grinding element 414 to rotate with the core element 412 as the shaft 28 rotates against the pressure of the article being grinded, the grinding element 414 is provided with an elongated ridge 436 that extends from the internal bore 432 the length of the grinding element 414. The ridge 436 engages within a slot 438 in the upper cylindrical portion 418 when the grinding element 414 is placed on the core element 412. Of course, it is not necessary that the ridge 436 extend the entire length of the grinding element 414, and the slot 438 extend the length of the upper cylindrical portion 418. In this configuration, the ridge and slot engagement will cause the grinding element 414 to rotate in association with rotation of the core element 414. Additionally, the grinding element 414 is readily removed from the core element 412 while the core element is attached to the shaft 28 by simply lifting up on the grinding element 414, and therefore, can be easily replaced with alternate grinding elements.

Figure 21:
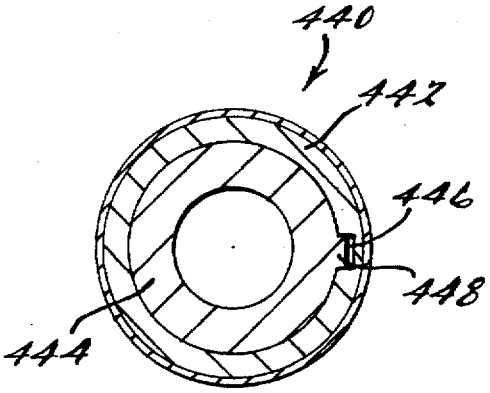
FIG. 21 is a top view of a grinding wheel assembly including a core element and a grinding bit element according to another embodiment of the present invention.

By the grinding bit assembly 410, the grinding bit element 414 can be replaced much more inexpensively than replacing the entire grinding bit assembly 410. Therefore, it is desirable that the grinding bit element 414 be as inexpensive as possible. This leads to developing a grinding bit element that has walls that are as thin as reasonable for the purposes described herein. Regardless, it may be possible to reverse the slot and ridge configuration as discussed above. FIG. 21 shows a top view of a grinding bit assembly 440 including a grinding element 442 mounted on a core element 444. In this embodiment, the grinding element 442 includes a slot 446, and the core element 442 includes a ridge 448 engaging in the slot 446 to allow rotation of the grinding element 442 upon rotation of the core element 444.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A grinding wheel assembly for securing to a drive shaft of an electric motor associated with a grinding apparatus, said grinding wheel assembly rotating upon rotation of the drive shaft, said grinding wheel assembly comprising:

a core element including an internal bore for accepting the drive shaft in a friction type fit, said core element including a core element securing means for securing the core element to the drive shaft so as to allow the core element to rotate as the drive shaft rotates, said core element including a slot extending at least a partial length of the core element; and a cylindrical grinding element including an outer layer of an abrasive grit material, said cylindrical grinding element including an internal bore that allows the grinding element to be slidably engaged onto the core element, said grinding element including a ridge member configured to be engaged within the slot when the grinding element is attached to the core element such that the grinding element will rotate upon rotation of the core element.

2. The grinding wheel assembly according to claim 1 wherein the core element includes a first cylindrical portion of one diameter and a second cylindrical portion of another diameter, wherein the one diameter of the first cylindrical portion is less than the another diameter of the second cylindrical portion so as to define a shoulder therebetween, said grinding element engageable with the first cylindrical portion of the core element and positionable on the shoulder.

3. The grinding wheel assembly according to claim 1 wherein the ridge member extends the entire length of the grinding element on the internal bore.

4. The grinding wheel assembly according to claim 1 wherein the first means for securing includes a set screw that extends through the core element and is configured to engage the drive shaft.

5. The grinding wheel assembly according to claim 1 wherein the grinding element is a cylindrical piece of brass having an abrasive diamond grit electroplated to an outer surface of the piece of brass.

6. A grinding wheel assembly for securing to a drive shaft of an electric motor associated with a grinding apparatus, said grinding wheel assembly rotating upon rotation of the drive shaft, said grinding wheel assembly comprising:

a core element including an internal bore for accepting the drive shaft in a friction type fit, said core element including a core element securing means for securing the core element to the drive shaft so as to allow the core element to rotate as the drive shaft rotates, said core element including a ridge extending at least a partial length of the core element; and a cylindrical grinding element including an outer layer of an abrasive grit material, said cylindrical grinding element including an internal bore that allows the grinding element to be slidably engaged onto the core element, said grinding element including a slot extending at least a partial length of the core element on the internal bore, said ridge member being configured to be engaged within the slot when the grinding element is attached to the core element such that the grinding element rotates upon rotation of the core element.

7. A method of providing a grinding assembly for grinding an article, said method comprising the steps of:

providing a grinding apparatus having an electric motor including a drive shaft;

providing a core element having an internal bore for accepting the drive shaft in a friction type fit, said step of providing a core element including providing a core element securing means for securing the core element to the drive shaft so as to allow the core element to rotate as the drive shaft rotates and providing a slot extending at least a partial length of the core element; and providing a cylindrical grinding element having an outer layer of an abrasive grit material, said step of providing a grinding element including providing a grinding element having an internal bore that allows the grinding element to be slidably engaged onto the core element and providing a ridge member secured to the internal bore and being configured to engage within the slot when the grinding element is attached to the core element such that the grinding element will rotate upon rotation of the core element.

* * * * *

UNITED STATES PATENT AND TRADEMARK OFFICE

CERTIFICATE OF CORRECTION

PATENT NO. : 5,681,211

DATED : October 28, 1997

INVENTOR(S) : Richard K. Wiand

It is certified that error appears in the above-identified patent and that said Letters Patent is hereby corrected as shown below:

Column 3, line 25, after "invention" insert --with--

Column 3, line 32, after "of" (first occurrence) insert --a--

Column 3, line 43, after "10(b)" insert --are--.

Column 3, line 64, after "15" delete "as" and insert --is--.

Signed and Sealed this

Sixteenth Day of June, 1998

*Attest:*

*Attesting Officer*

Bruce Lehman

BRUCE LEHMAN

*Commissioner of Patents and Trademarks*